US011580800B2

(12) United States Patent
Ghosh et al.

(10) Patent No.: US 11,580,800 B2
(45) Date of Patent: Feb. 14, 2023

(54) COMPUTER VISION BASED VEHICLE INSPECTION REPORT AUTOMATION

(71) Applicant: Verizon Patent and Licensing Inc., Arlington, VA (US)

(72) Inventors: Debrup Ghosh, Lake Forest, CA (US); Harsh Shah, Stevenson Ranch, CA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 360 days.

(21) Appl. No.: 16/184,564

(22) Filed: Nov. 8, 2018

(65) Prior Publication Data

US 2020/0151974 A1 May 14, 2020

(51) Int. Cl.
*G07C 5/08* (2006.01)
*G07C 5/00* (2006.01)

(52) U.S. Cl.
CPC ..... *G07C 5/0866* (2013.01); *G07C 5/008* (2013.01)

(58) Field of Classification Search
CPC combination set(s) only.
See application file for complete search history.

(56) References Cited

U.S. PATENT DOCUMENTS 8,756,085 B1 * 6/2014 Plummer ..... G06Q 40/08 705/4
9,804,577 B1 * 10/2017 Troy ..... G05B 15/02
9,824,453 B1 * 11/2017 Collins ..... G06Q 40/08
10,319,094 B1 * 6/2019 Chen ..... G06F 3/0484
10,417,911 B2 * 9/2019 Herman ..... G06Q 10/20
10,497,108 B1 * 12/2019 Knuffman ..... G06T 7/0004
10,515,419 B1 * 12/2019 Walker ..... G06K 9/00442
10,534,968 B1 * 1/2020 Clauss ..... G06K 9/6215
10,636,148 B1 * 4/2020 Chen ..... G06T 3/40
10,699,404 B1 * 6/2020 Nussbaum ..... G06Q 40/08
10,740,891 B1 * 8/2020 Chen ..... G06T 7/001
10,762,385 B1 * 9/2020 Yang ..... G06N 3/08
10,791,265 B1 * 9/2020 Lambert ..... H04N 5/23222
10,825,201 B2 * 11/2020 Sarukkai ..... G06K 9/627
10,837,788 B1 * 11/2020 Kentley-Klay .... G01C 21/3623
(Continued)

FOREIGN PATENT DOCUMENTS

WO WO-2007032025 A2 * 3/2007 ..... G06T 7/0004

*Primary Examiner* — Anne Marie Antonucci
*Assistant Examiner* — Amelia Vorce

(57) ABSTRACT

A device receives a vehicle inspection report submission including imaging information identifying a set of images of a vehicle from a user device, and identifies and obtains, from a data structure, a set of stored vehicle attributes relating to a previous condition of the vehicle. The device determines, based on the set of images and using computer vision processing, a set of identified vehicle attributes that relate to a present condition of the vehicle. The device selectively validates, based on the set of identified vehicle attributes and the set of stored vehicle attributes and based on location information identifying the user device within a threshold proximity of the vehicle when the set of images were captured, the vehicle inspection report submission. The device transmits information identifying a result of selectively validating the vehicle inspection report submission, selectively updates the vehicle attribute record, and selectively provides the updated vehicle attribute record.

20 Claims, 9 Drawing Sheets

(56) References Cited

U.S. PATENT DOCUMENTS

2005/0040224 A1* 2/2005 Brinton ..... G08G 1/20 235/376
2006/0114531 A1* 6/2006 Webb ..... G01N 21/8851 359/15
2007/0177787 A1* 8/2007 Maeda ..... G06K 9/00557 382/141
2008/0239079 A1* 10/2008 Millar ..... G06K 9/00577 348/148
2014/0132729 A1* 5/2014 Foulk ..... G06F 30/00 348/46
2016/0185469 A1* 6/2016 Ujita ..... G01N 21/8806 348/129
2016/0271796 A1* 9/2016 Babu ..... B25J 11/0075
2017/0078901 A1* 3/2017 Iwanaga ..... H04W 24/04
2017/0116743 A1* 4/2017 Matsumoto ..... G06K 9/00805
2017/0148102 A1* 5/2017 Franke ..... G06Q 30/0278
2017/0221110 A1* 8/2017 Sullivan ..... G06K 9/78
2017/0293894 A1* 10/2017 Taliwal ..... G06T 7/143
2018/0012350 A1* 1/2018 Gangitano ..... H04N 7/188
2018/0114302 A1* 4/2018 Sweers ..... G06K 9/6267
2018/0137614 A1* 5/2018 Prabhu ..... H04N 5/23293
2018/0155057 A1* 6/2018 Irish ..... G05D 1/0094
2018/0260793 A1* 9/2018 Li ..... G06Q 30/0283
2019/0073641 A1* 3/2019 Utke ..... G06T 7/0004
2019/0174071 A1* 6/2019 Wasner ..... G01N 21/8806
2019/0179320 A1* 6/2019 Pacala ..... G01S 17/89
2019/0185186 A1* 6/2019 Li ..... B64F 5/60
2019/0311555 A1* 10/2019 Troy ..... G06K 9/00624
2020/0064230 A1* 2/2020 Kain Venkatadri .... G06N 5/003
2020/0074215 A1* 3/2020 Wang ..... G06T 7/70
2020/0074560 A1* 3/2020 Xu ..... G06K 9/036
2020/0082168 A1* 3/2020 Fathi ..... B64C 39/024
2020/0090429 A1* 3/2020 Navarrete ..... G06K 9/6267
2020/0134728 A1* 4/2020 Vickers ..... G06Q 40/08
2020/0300779 A1* 9/2020 Nakanishi ..... G06T 7/0002
2021/0097454 A1* 4/2021 Stebbins ..... G06Q 10/06398

* cited by examiner

COMPUTER VISION BASED VEHICLE INSPECTION REPORT AUTOMATION

BACKGROUND

A vehicle inspection report can be completed to record a condition of a motor vehicle. For example, some commercial motor vehicle operators are required to complete driver vehicle inspection reports (DVIRs) each time a commercial vehicle is operated. An operator of a vehicle can record information regarding the vehicle, such as information identifying a license plate number, a vehicle mileage, a vehicle condition (e.g., a presence of dents, scratches, etc.), and/or the like. Further, the operator of the vehicle can identify one or more events occurring during operation of the vehicle, such as a traffic accident, a change to a vehicle condition (e.g., a new dent), and/or the like. In some cases, the operator of the vehicle can be required to submit multiple photographs of the vehicle as a part of the vehicle inspection report. Vehicle inspection reports can be useful in determining a cause of an event (e.g., a cause of a vehicle crash), a condition of a vehicle, and/or the like.

DETAILED DESCRIPTION OF PREFERRED EMBODIMENTS

Figure 1A:
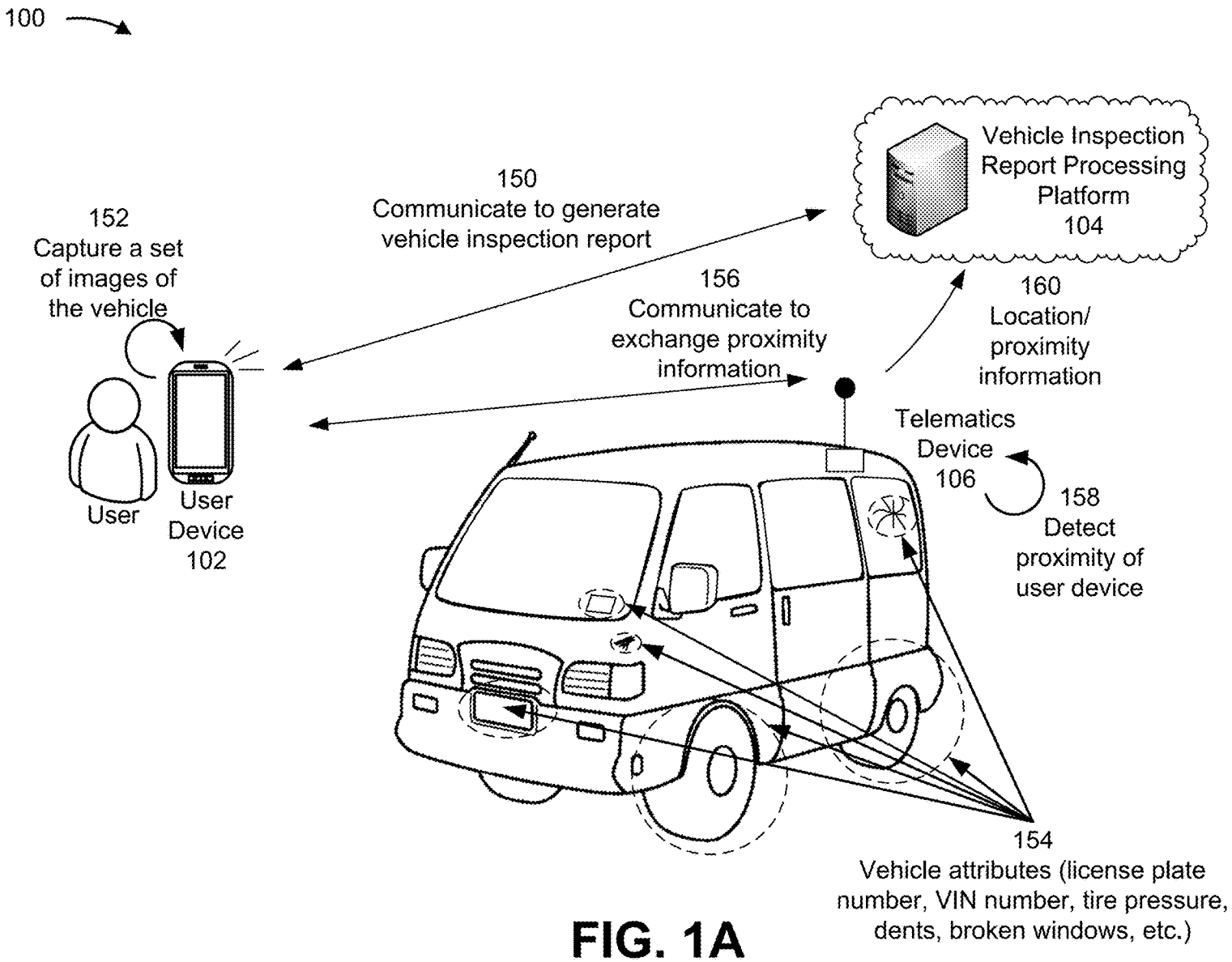
FIGS. 1A-1E are diagrams of an example implementation described herein.

The following detailed description of example implementations refers to the accompanying drawings. The same reference numbers in different drawings can identify the same or similar elements.

As described above, an operator of a vehicle can complete a vehicle inspection report, such as a driver vehicle inspection report (DVIR), after using a vehicle. The operator of the vehicle can take a set of photographs of the vehicle, and can include the photographs in the vehicle inspection report. An inspector can review the vehicle inspection report to validate that the vehicle inspection report is complete, that the vehicle inspection report is not fraudulent, and/or the like. In some cases, however, completion of vehicle inspection reports and validation of vehicle inspection reports with human intervention can be error prone. For example, an operator of a vehicle can use older photographs stored on the operator's user device to conceal new damage to the vehicle. Similarly, the operator of the vehicle can use current photographs of a similar looking vehicle. The inspector can fail to recognize fraud in the vehicle inspection reports. This can result in damaged vehicles being deployed for use on a public road, which can pose a danger to the operator, to other motorists, to pedestrians, and/or the like. Further, review of vehicle inspection reports with human intervention can be time and resource intensive.

Some implementations described herein can enable vehicle inspection report automation. For example, a vehicle inspection report processing platform can provide a user interface to guide a user in completing a vehicle inspection report, can receive a vehicle inspection report submission, can use computer vision to automatically validate the vehicle inspection report submission, and can automatically perform response actions based on validating the vehicle inspection report submission. In this case, the vehicle inspection report processing platform can automatically schedule maintenance for a vehicle, alter a schedule of use of the vehicle, update a vehicle attribute record to reflect a new event (e.g., new damage to the vehicle), and/or the like.

In this way, implementations described herein use a rigorous, computerized process to validate vehicle inspection reports and respond to events identified based on the vehicle inspection reports, processes that were not previously performed or were previously performed using subjective human intuition or input. For example, currently there does not exist a technique to accurately automate vehicle inspection report collection and processing. Moreover, based on automating vehicle inspection report processing, implementations described herein can enable use of big data analytics to evaluate vehicle inspection reports to predict subsequent vehicle damage, thereby enabling preemptive maintenance, which can increase vehicle safety. Further, by automating vehicle inspection report collection and processing, a utilization of computing resources associated with reviewing and validating vehicle inspection reports can be reduced relative to requiring human intervention to process vehicle inspection reports. Additionally, or alternatively, as described herein, by using proximity information to validate vehicle inspection reports, a likelihood of incorrectly invalidating a vehicle inspection report is reduced, thereby reducing a utilization of computing resources associated with recreating the vehicle inspection report after incorrectly invalidating the vehicle inspection report.

FIGS. 1A-1E are diagrams of an example implementation 100 described herein. As shown in FIG. 1A, example implementation 100 includes a user device 102, a vehicle inspection report processing platform 104, and a telematics device 106. In some implementations, the vehicle inspection report processing platform can be implemented in a cloud computing environment, as described in more detail herein.

As further shown in FIG. 1A, and by reference number 150, user device 102 and vehicle inspection report processing platform 104 can communicate to generate a vehicle inspection report. For example, vehicle inspection report processing platform 104 can provide a user interface for display via user device 102 to guide a user in completing the vehicle inspection report, as described in more detail herein. In some implementations, vehicle inspection report processing platform 104 may automatically transmit a request for completion of a vehicle inspection report, such as based on receiving location data indicating that a vehicle is at a destination, a repair facility, a depot, and/or the like. As shown by reference number 152, user device 102 can capture a set of images of the vehicle for inclusion in the vehicle inspection report. For example, a user of user device 102 (e.g., a vehicle operator) can use user device 102 to capture a pre-configured set of images, such as a front view, a side view, an angled view, a detailed view, and/or the like of the vehicle. Additionally, or alternatively, vehicle inspection report processing platform 104 can dynamically provide an indication that user device 102 is to capture a particular view of the vehicle. For example, for a vehicle with a rear license plate and no front license plate, vehicle inspection report processing platform 104 can cause user device 102 to only capture a rear view of the vehicle. In contrast, for a vehicle with both a rear license plate and a front license plate, vehicle inspection report processing platform 104 can cause user device 102 to capture a front view and a rear view of the vehicle. In some implementations, vehicle inspection report processing platform 104 may cause user device 102 to not allow use of another functionality of user device 102 until a specified set of images are captured. In some implementations, vehicle inspection report processing platform 104 may provide a previous image of a vehicle to enable a user to quickly identify which image is needed in a specified set of images. In some implementations, vehicle inspection report processing platform 104 may cause user device 102 to vibrate, beep, or provide another alert when a particular angle or view of the vehicle is achieved.

In some implementations, user device 102 can capture another type of view of the vehicle. For example, user device 102 can capture a video of the vehicle, an audio recording of the vehicle, a 360 degree view of the vehicle (e.g., using a photographic stitching technique), and/or the like. In some implementations, vehicle inspection report processing platform 104 can communicate with another device to capture images of the vehicle. For example, when the vehicle is moved to a maintenance garage with a set of connected imaging devices, vehicle inspection report processing platform 104 can communicate with the set of connected imaging devices to cause the set of connected imaging devices to automatically capture a set of images of the vehicle. Additionally, or alternatively, subject to opt-in and/or information privacy requirements (e.g., a vehicle operator or device owner can provide permission), vehicle inspection report processing platform 104 can communicate with other connected devices, such as connected street cameras, other connected vehicles, other user devices, and/or the like to obtain the set of images of the vehicle. In this case, vehicle inspection report processing platform 104 may use location information regarding the vehicle to select one or more connected devices to use for obtaining images of the vehicle.

As further shown in FIG. 1A, and by reference number 154, user device 102 can capture images to identify a set of vehicle attributes of the vehicle. For example, user device 102 can capture images of a license plate number, a vehicle identification number (VIN number), a tire pressure gauge, an odometer, a dent, a broken window, and/or the like. As shown by reference numbers 156, 158, and 160, in some implementations, user device 102 and telematics device 106 can communicate to exchange proximity information and/or location information. For example, telematics device 106 can detect a Bluetooth beacon of user device 102, and can relay identification information to indicate that user device 102 is within a threshold proximity of the vehicle, thereby reducing a likelihood of a fraudulent vehicle inspection report being submitted (e.g., of another, similar looking vehicle at another location).

Additionally, or alternatively, telematics device 106 and user device 102 can each provide location information to vehicle inspection report processing platform 104 to enable vehicle inspection report processing platform 104 to determine that user device 102 and the vehicle were within a threshold proximity at a time at which images were captured for the vehicle inspection report. Additionally, or alternatively, telematics device 106 can display a unique code (e.g., a time-based code, a blockchain based code, and/or the like) that can be visible (e.g., to the human eye, to a computer vision engine in a non-visible spectrum, and/or the like) in one or more images of the vehicle inspection report to reduce a likelihood of fraud (e.g., by ensuring that the images include intrinsic information identifying a location, a time, a vehicle, and/or the like rather than relying on extrinsic information such as Exif data associated with the image).

Figure 1B:
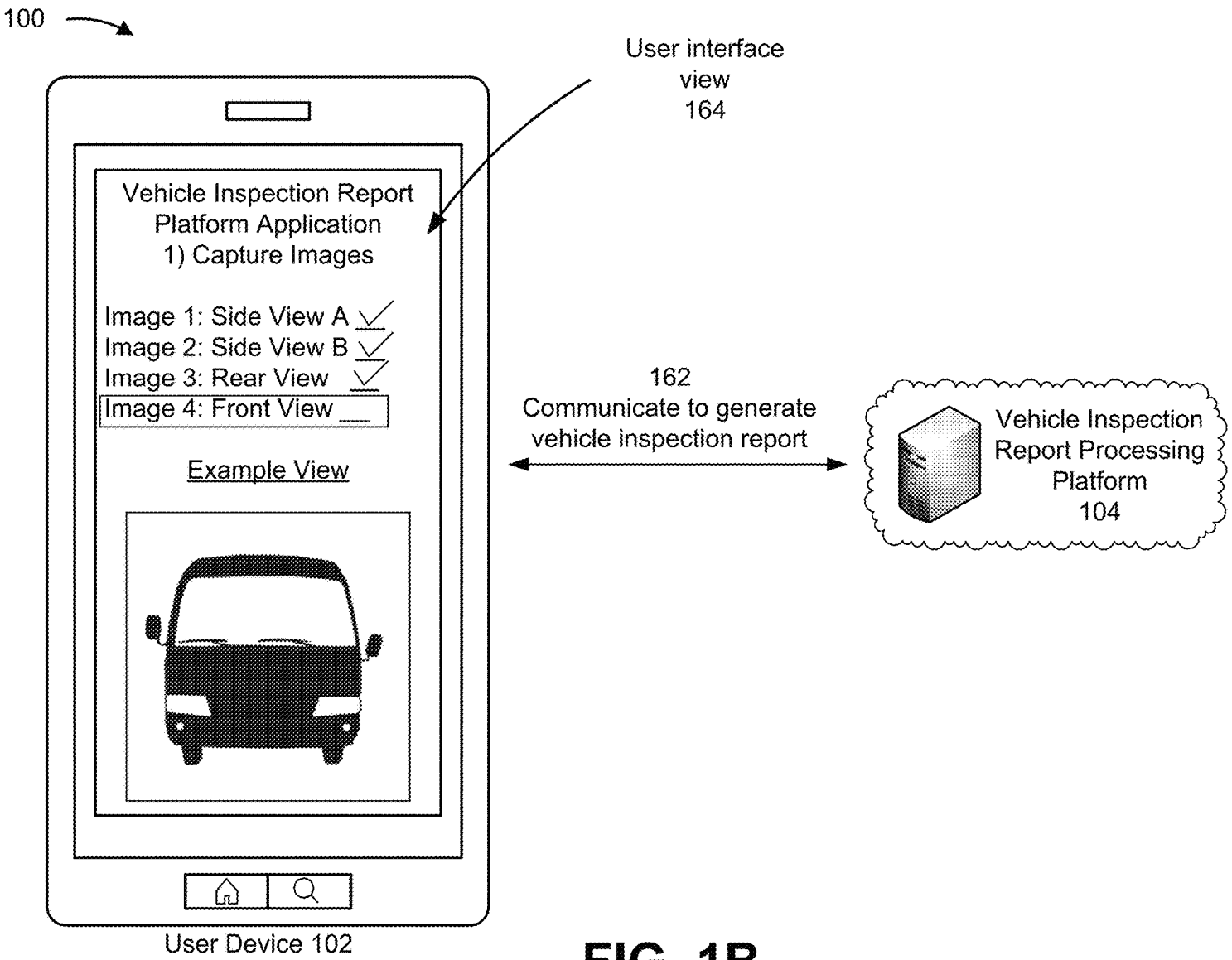

As shown in FIG. 1B, and as described above, user device 102 can, when communicating to generate the vehicle inspection report, provide a user interface view 164 to assist a user in capturing images for the vehicle inspection report. For example, user device 102 can indicate a set of image subjects that the user is to use user device 102 to capture (e.g., a first side view, a second side view, a rear view, a front view, a license plat view, etc.). Additionally, or alternatively, user device 102 can indicate one or more images that the user has not yet used user device 102 to capture. In some implementations, user device 102 can provide a user interface including an example of an image that the user is to use user device 102 to capture. In some implementations, user device 102 can provide an augmented reality view to assist a user in aligning user device 102 to a vehicle to capture an image of a vehicle that can be matched against a previous image of the vehicle. For example, user device 102 can overlay the previous image of the vehicle on a display with a current view from a camera of user device 102.

In some implementations, user device 102 can automatically detect that the current view from a camera of user device 102 matches the previous image of the vehicle (e.g., by using computer vision techniques to align recognized objects in the previous image to recognized objects in the current view). Additionally, or alternatively, user device 102 can use one or more sensors to determine that the current view is aligned or to guide the user in aligning the current view. In some implementations, processing to provide the user interface can be performed by vehicle inspection report processing platform 104 remote from user device 102. In this way, user device 102 reduces a difficulty in capturing images for the vehicle inspection report. Moreover, based on ensuring that images in the vehicle inspection report accurately correspond to previous images of the vehicle (e.g., in terms of an angle at which an image is captured), user device 102 can reduce an amount of processing by vehicle inspection report processing platform 104 to analyze images in the vehicle inspection report relative to less well matched images.

Figure 1C:
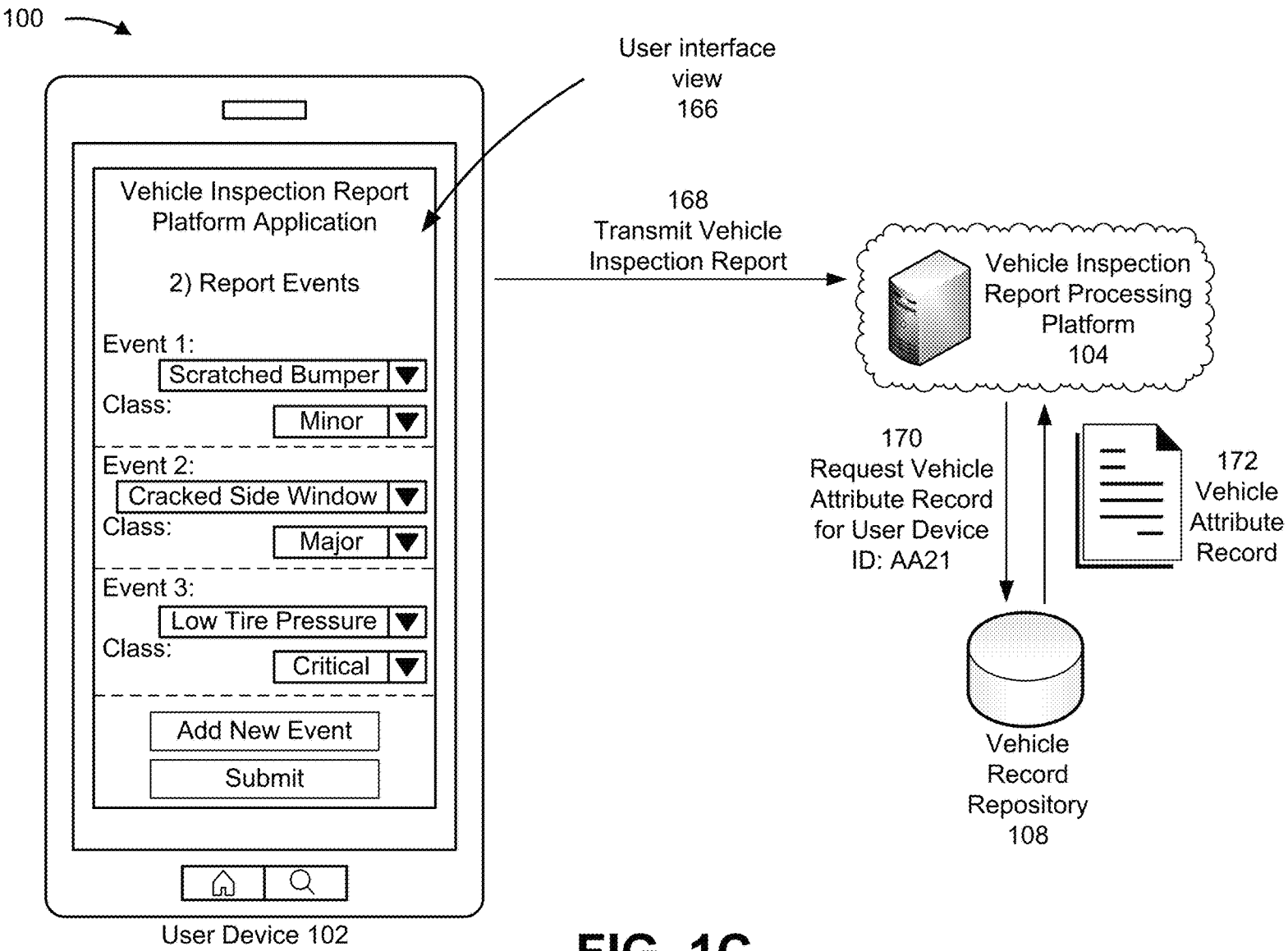

As shown in FIG. 1C, and as described above, user device 102 can, when communicating to generate the vehicle inspection report, provide a user interface view 166 to assist a user in reporting events relating to the vehicle. For example, user device 102 can provide an interface with which a user can report an accident (e.g., a scratched bumper, a cracked side window, etc.), an indicator value (e.g., a tire pressure value, a state of a tire pressure indicator, an odometer value, a check engine light indicator status, etc.), and/or the like. In some implementations, user device 102 can provide an interface with which a user can classify an event or a condition associated therewith into a particular classification. For example, a user can indicate that a scratched bumper is a minor class of event, a cracked side window is a major class of event, and low tire pressure is a critical class of event. Additionally, or alternatively, vehicle inspection report processing platform 104 can automatically classify events and/or conditions of a vehicle associated therewith based on processing images of the vehicle inspection report. Other classifications can be possible that differ from those described herein.

As further shown in FIG. 1C, and by reference number 168, user device 102 can transmit, and vehicle inspection report processing platform 104 can receive a vehicle inspection report. In some implementations, vehicle inspection report processing platform 104 can identify a vehicle based on a vehicle inspection report submission. For example, vehicle inspection report processing platform 104 can receive information in the vehicle inspection report submission identifying the vehicle (e.g., a vehicle identifier, a user identifier, a user device identifier, and/or the like. Additionally, or alternatively, vehicle inspection report processing platform 104 can perform initial processing of images in the vehicle inspection report submission to identify the vehicle (e.g., to identify a license plate number, a VIN number, a vehicle model, etc.).

As further shown in FIG. 1C, and by reference numbers 170 and 172, vehicle inspection report processing platform 104 can request and receive a vehicle attribute record for the vehicle. For example, based on determining a user device identifier for user device 102 (User Device ID: AA21), vehicle inspection report processing platform 104 can request a vehicle attribute record for a vehicle associated with user device 102. In this case, vehicle record repository 108, which can be a data structure storing vehicle attribute records, vehicle inspection reports, and/or the like, can provide the vehicle attribute record for the vehicle associated with user device 102. In some implementations, a vehicle attribute record can include information identifying a set of stored vehicle attributes, such as information identifying a condition of the vehicle, an odometer reading of the vehicle, and/or the like. Additionally, or alternatively, the vehicle attribute record can include a set of images of the vehicle, such as a set of images obtained from a previous vehicle inspection report submission, images obtained after maintenance was performed on the vehicle, and/or the like.

Figure 1D:
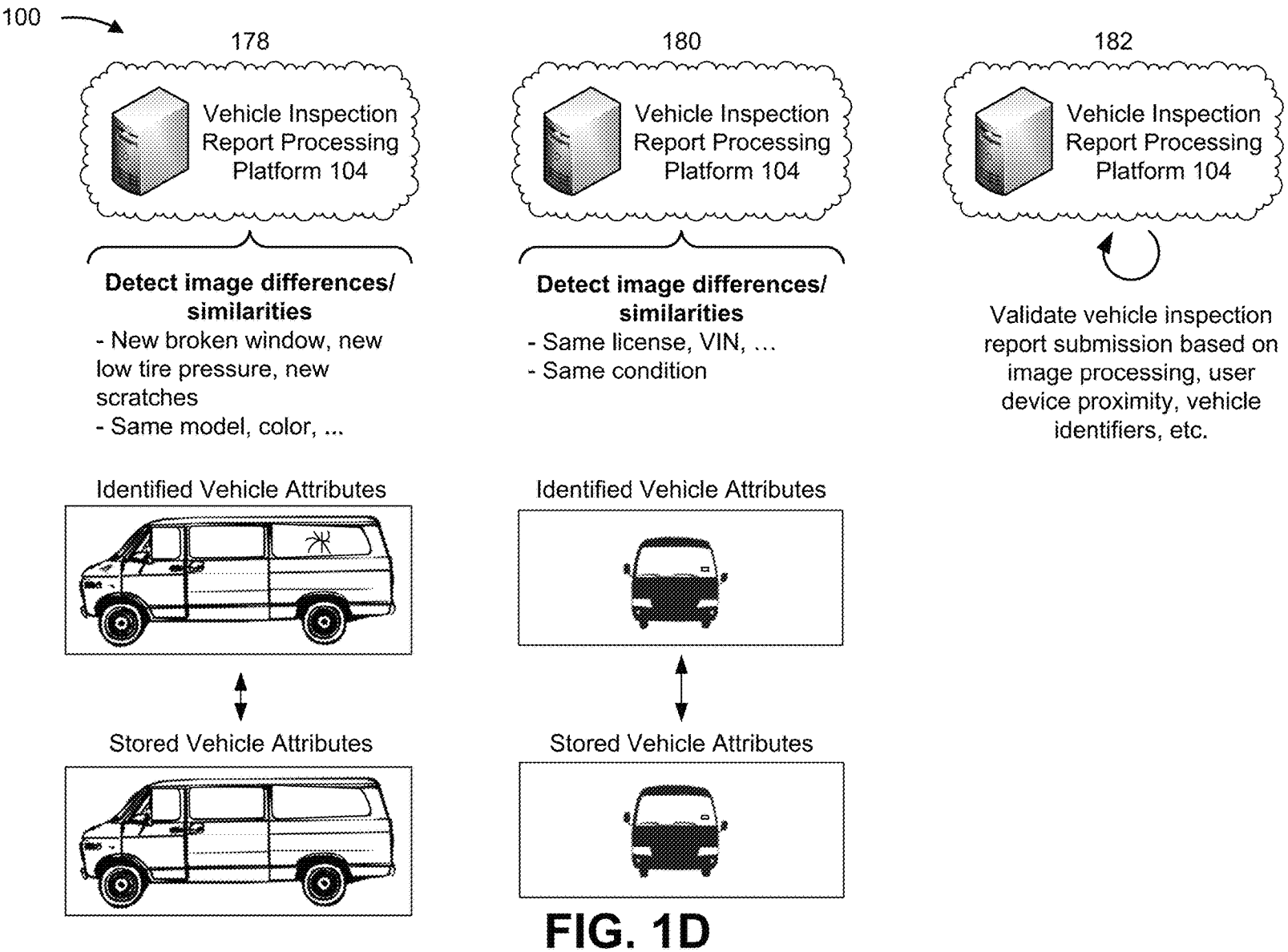

As shown in FIG. 1D, and by reference number 178, vehicle inspection report processing platform 104 can process images of the vehicle. For example, vehicle inspection report processing platform 104 can process the set of images of the vehicle inspection report to determine identified vehicle attributes of a vehicle in the set of images of the vehicle. Additionally, or alternatively, vehicle inspection report processing platform 104 can process another set of images of the vehicle attribute record to determine stored vehicle attributes.

In some implementations, vehicle inspection report processing platform 104 can detect image differences and/or similarities between the set of images in the vehicle inspection report submission and another set of images in the vehicle attribute record. For example, in a side view image of the vehicle from the vehicle inspection report, vehicle inspection report processing platform 104 can detect a broken window, a low tire pressure (e.g., based on a shape of the tires), and a set of scratches that were not present in a corresponding image of the vehicle attribute record. Additionally, or alternatively, vehicle inspection report processing platform 104 can determine that each image is of a same vehicle model, a same vehicle color, and/or the like. As shown by reference number 180, based on a front view image in the vehicle inspection report submission and a corresponding front view image in the vehicle attribute record, vehicle inspection report processing platform 104 can determine that each image is of a same license plate number, a same VIN number, a same vehicle condition (e.g., no damage to a front of the vehicle), and/or the like.

In some implementations, vehicle inspection report processing platform 104 can use a computer vision technique to process images. For example, vehicle inspection report processing platform 104 can perform object recognition to determine a model of a vehicle, damage to the vehicle, a condition of the vehicle (e.g., a flat tire), and/or the like. Similarly, vehicle inspection report processing platform 104 can use computer vision to parse text present in an image, such as a license plate number, a VIN number, and/or the like. In some implementations, vehicle inspection report processing platform 104 can identify other intrinsic attributes of an image, such as an identifier provided by a telematics device as described above. In some implementations, vehicle inspection report processing platform 104 can identify extrinsic attributes of an image, such as by parsing Exif data of the image to identify a time at which the image was captured, a location at which the image was captured, and/or the like.

As further shown in FIG. 1D, and by reference number 182, vehicle inspection report processing platform 104 can determine whether to validate the vehicle inspection report submission. For example, vehicle inspection report processing platform 104 can use information regarding a proximity of user device 102 to the vehicle, information regarding vehicle identifiers, information regarding a condition of the vehicle (e.g., a same condition of the vehicle) to determine that the vehicle inspection report is valid and not fraudulent (e.g., that images were not of another vehicle, were not captured at a different time before damage occurred to the vehicle, and/or the like).

In some implementations, vehicle inspection report processing platform 104 can use event information to resolve discrepancies between the vehicle inspection report and the vehicle attribute record to validate the vehicle inspection report. For example, when vehicle inspection report processing platform 104 detects damage to the vehicle in an image, and the vehicle inspection report includes information identifying an event causing the damage, vehicle inspection report processing platform 104 can determine that the image is not fraudulent despite the image not matching a previous image of the vehicle. Similarly, vehicle inspection report processing platform 104 can determine that an image of the vehicle inspection report that does not include damage identified from the vehicle attribute record, and can determine the vehicle inspection report is invalid.

In some implementations, vehicle inspection report processing platform 104 can use an analytics technique to validate the vehicle inspection report submission. For example, vehicle inspection report processing platform 104 can use a statistical model of vehicle wear to determine that damage is expected to occur with a threshold likelihood in an image of the vehicle inspection report (e.g., based on normal wear and tear on the vehicle since a last update of the vehicle attribute record). In this case, vehicle inspection report processing platform 104 can determine that the vehicle inspection report submission is invalid when the expected damage is not observed.

As an example, vehicle inspection report processing platform 104 can predict that a small dent is to expand to a larger dent over time, and can invalidate a vehicle inspection report as potentially fraudulent based on the small dent not appearing to have expanded in an image of the vehicle inspection report. In some implementations, vehicle inspection report processing platform 104 can apply weights to multiple factors when validating the vehicle inspection report submission, such as proximity information, a presence of vehicle identifiers in images, a presence of damage in images, and/or the like, and can determine a score based on the weights. In this case, vehicle inspection report processing platform 104 can determine that the vehicle inspection report is valid based on a threshold score being achieved. In some implementations, vehicle inspection report processing platform 104 can train an analytics model based on hundreds, thousands, millions, or billions of data points from vehicle inspection reports, vehicle maintenance records, and/or the like.

In some implementations, vehicle inspection report processing platform 104 can evaluate an image of the vehicle inspection report against multiple previous images. For example, vehicle inspection report processing platform 104 can determine a first level of validation based on the image matching a previous image captured by the user of user device 102, and can determine a second level of validation based on the image matching a previous image captured by a third party (e.g., a maintenance professional during servicing of the vehicle).

Figure 1E:
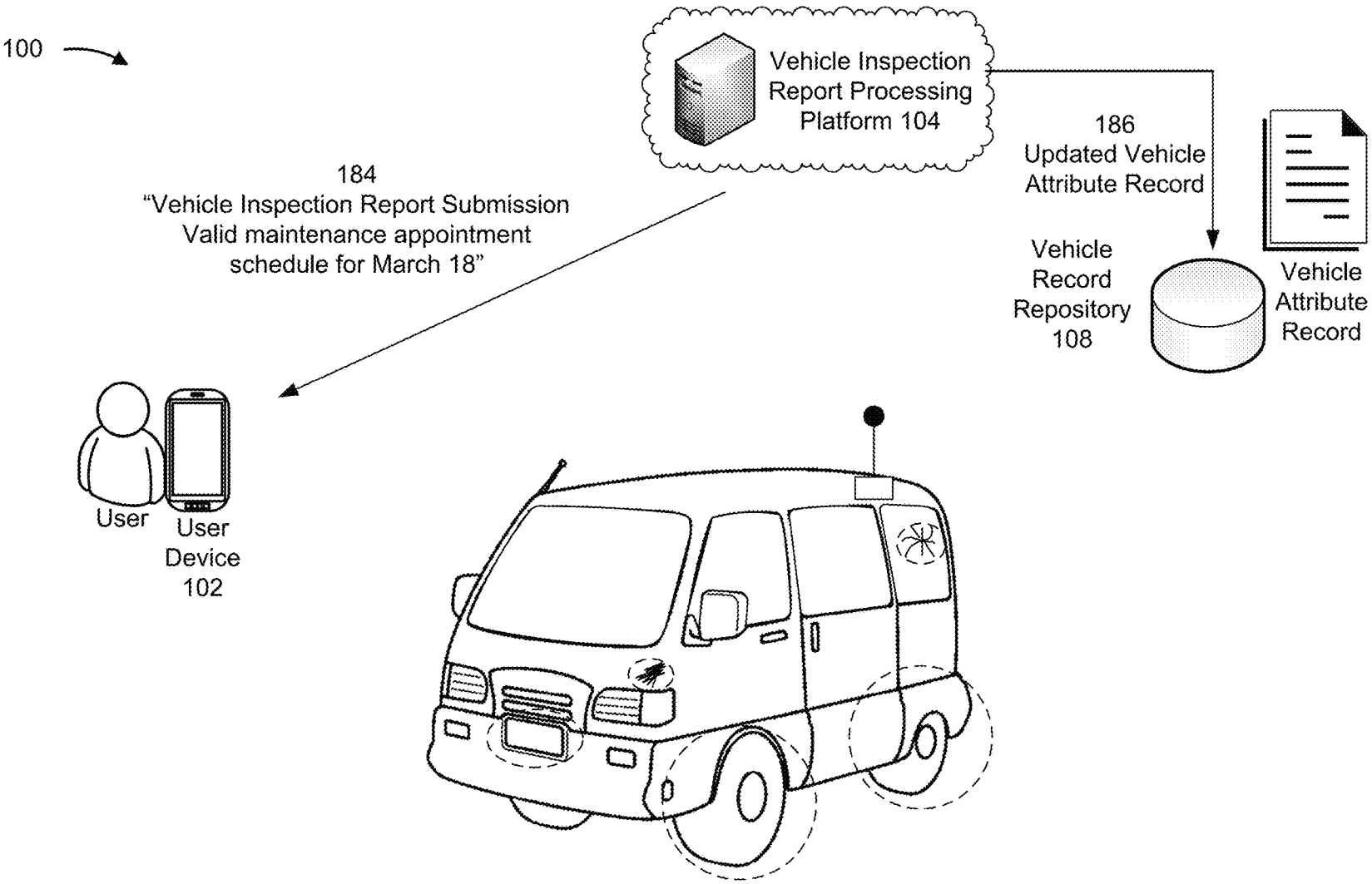

As shown in FIG. 1E, and by reference number 184, vehicle inspection report processing platform 104 can provide an indication of whether the vehicle inspection report submission is validated. For example, vehicle inspection report processing platform 104 can indicate that the vehicle inspection report is validated. Additionally, or alternatively, vehicle inspection report processing platform 104 can indicate that the vehicle inspection report is not validated. In this case, vehicle inspection report processing platform 104 can indicate a reason for invalidation (e.g., blurry images, inability to obtain location information, failure to identify new damage to the vehicle, etc.), and can request follow-up information to validate the vehicle inspection report (e.g., additional images, additional information identifying an event, a new vehicle inspection report submission, etc.).

In some implementations, vehicle inspection report processing platform 104 can perform another response action. For example, vehicle inspection report processing platform 104 can automatically schedule maintenance for the vehicle based on a condition of the vehicle determined based on the vehicle inspection report. In this case, vehicle inspection report processing platform 104 can communicate with user device 102, a scheduling platform of a maintenance facility, a scheduling platform for scheduling use of the vehicle, to update schedules based on the condition of the vehicle (e.g., to prohibit use of the vehicle until maintenance is completed, to indicate that maintenance is to occur at a particular time, etc.). Similarly, vehicle inspection report processing platform 104 can provide an indication that a maintenance professional is to provide updated images of the vehicle after the maintenance to ensure that the vehicle attribute record is up to date.

As further shown in FIG. 1E, and by reference number 186, vehicle inspection report processing platform 104 can provide an updated vehicle attribute record for storage in vehicle record repository 108. For example, vehicle inspection report processing platform 104 can determine that attributes of the vehicle have changed (e.g., new images have been captured and validated in the vehicle inspection report, new damage is identified, etc.), and can store information identifying the changed attributes (e.g., a new set of images) for use in validating a subsequent vehicle inspection report. Additionally, or alternatively, vehicle inspection report processing platform 104 can update the vehicle attribute record based on update information included in the vehicle inspection report. For example, the vehicle inspection report can include user provided information (e.g., an attribute change report) indicating that a logo on the vehicle has been removed, and vehicle inspection report processing platform 104 can update the vehicle attribute record to indicate that the logo is no longer on the vehicle. In some implementations, when the vehicle inspection report is not validated, vehicle inspection report processing platform 104 can maintain a current version of the vehicle attribute record and cannot update the vehicle attribute record.

In this way, vehicle inspection report processing platform 104 automates validation of vehicle inspection reports and performs response actions to reduce a likelihood of fraud, reduce an amount of time that a vehicle remains damaged without maintenance occurring, and/or the like. Further, by automating vehicle inspection report collection and processing, vehicle inspection report processing platform 104 reduces a utilization of computing resources associated with reviewing and validating vehicle inspection reports relative to requiring human intervention to process vehicle inspection reports.

As indicated above, FIGS. 1A-1E are provided merely as an example. Other examples can differ from what was described with regard to FIGS. 1A-1E.

Figure 2:
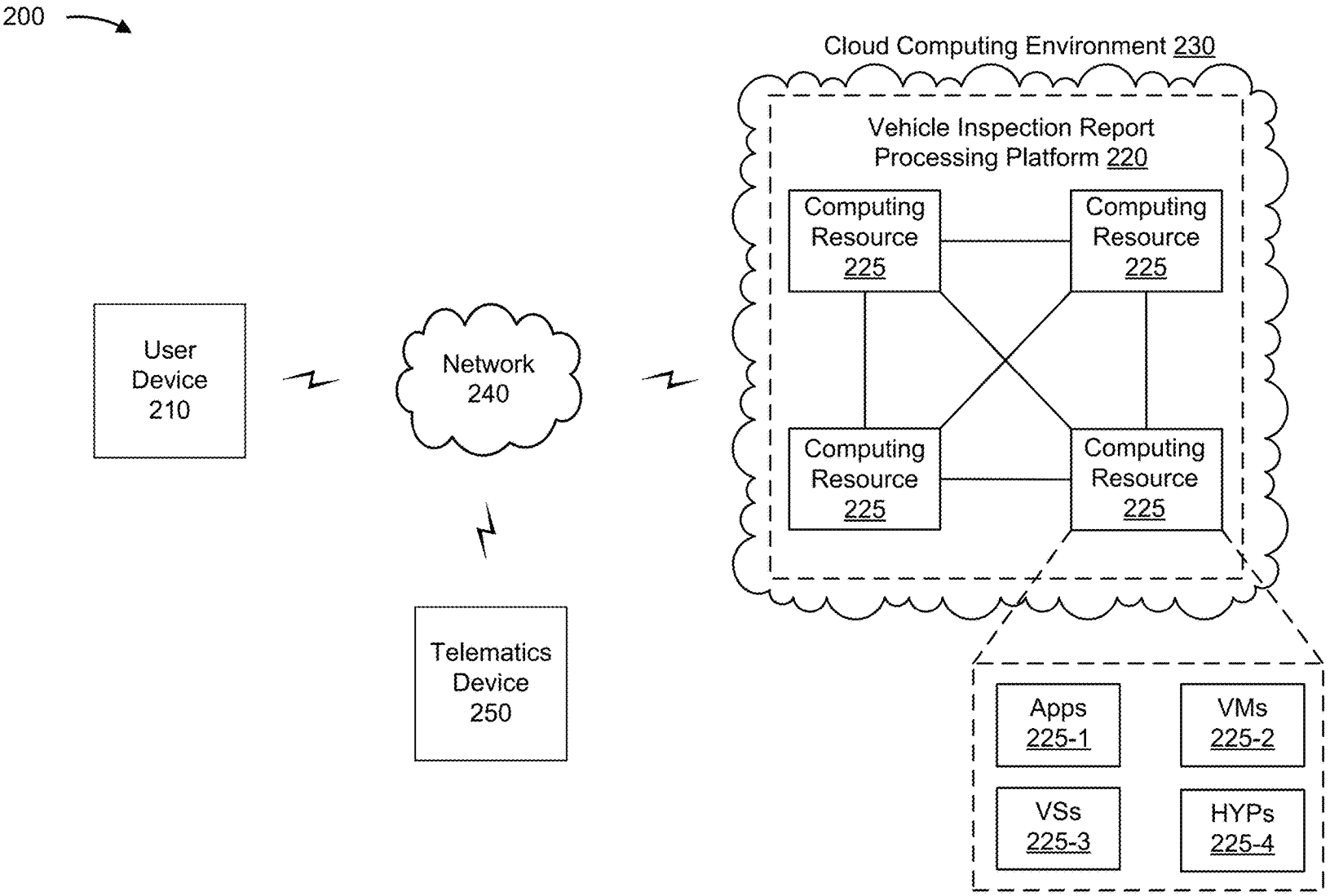
FIG. 2 is a diagram of an example environment in which systems and/or methods, described herein, can be implemented.

FIG. 2 is a diagram of an example environment 200 in which systems and/or methods, described herein, can be implemented. As shown in FIG. 2, environment 200 can include a user device 210, a vehicle inspection report processing platform 220, a computing resource 225, a cloud computing environment 230, a network 240, and a telematics device 250. Devices of environment 200 can interconnect via wired connections, wireless connections, or a combination of wired and wireless connections.

User device 210 includes one or more devices capable of receiving, generating, storing, processing, and/or providing information associated with generating a vehicle inspection report. For example, user device 210 can include a communication and/or computing device, such as a mobile phone (e.g., a smart phone, a radiotelephone, etc.), a laptop computer, a tablet computer, a handheld computer, a gaming device, a wearable communication device (e.g., a smart wristwatch, a pair of smart eyeglasses, etc.), or a similar type of device.

Vehicle inspection report processing platform 220 includes one or more computing resources assigned to process a vehicle inspection report. For example, vehicle inspection report processing platform 220 can be a platform implemented by cloud computing environment 230 that can use computer vision to detect similarities and/or differences between images of the vehicle inspection report and stored images of a vehicle attribute record to validate the vehicle inspection report. In some implementations, vehicle inspection report processing platform 220 is implemented by computing resources 225 of cloud computing environment 230.

Vehicle inspection report processing platform 220 can include a server device or a group of server devices. In some implementations, vehicle inspection report processing platform 220 can be hosted in cloud computing environment 230. Notably, while implementations described herein describe vehicle inspection report processing platform 220 as being hosted in cloud computing environment 230, in some implementations, vehicle inspection report processing platform 220 can be non-cloud-based or can be partially cloud-based.

Cloud computing environment 230 includes an environment that delivers computing as a service, whereby shared resources, services, etc. can be provided to process a vehicle inspection report. Cloud computing environment 230 can provide computation, software, data access, storage, and/or other services that do not require end-user knowledge of a physical location and configuration of a system and/or a device that delivers the services. As shown, cloud computing environment 230 can include vehicle inspection report processing platform 220 and computing resource 225.

Computing resource 225 includes one or more personal computers, workstation computers, server devices, or another type of computation and/or communication device. In some implementations, computing resource 225 can host vehicle inspection report processing platform 220. The cloud resources can include compute instances executing in computing resource 225, storage devices provided in computing resource 225, data transfer devices provided by computing resource 225, etc. In some implementations, computing resource 225 can communicate with other computing resources 225 via wired connections, wireless connections, or a combination of wired and wireless connections.

As further shown in FIG. 2, computing resource 225 can include a group of cloud resources, such as one or more applications ("APPs") 225-1, one or more virtual machines ("VMs") 225-2, virtualized storage ("VSs") 225-3, one or more hypervisors ("HYPs") 225-4, or the like.

Application 225-1 includes one or more software applications that can be provided to or accessed by user device 210. Application 225-1 can eliminate a need to install and execute the software applications on user device 210. For example, application 225-1 can include software associated with vehicle inspection report processing platform 220 and/or any other software capable of being provided via cloud computing environment 230. In some implementations, one application 225-1 can send/receive information to/from one or more other applications 225-1, via virtual machine 225-2.

Virtual machine 225-2 includes a software implementation of a machine (e.g., a computer) that executes programs like a physical machine. Virtual machine 225-2 can be either a system virtual machine or a process virtual machine, depending upon use and degree of correspondence to any real machine by virtual machine 225-2. A system virtual machine can provide a complete system platform that supports execution of a complete operating system ("OS"). A process virtual machine can execute a single program, and can support a single process. In some implementations, virtual machine 225-2 can execute on behalf of a user (e.g., user device 210), and can manage infrastructure of cloud computing environment 230, such as data management, synchronization, or long-duration data transfers.

Virtualized storage 225-3 includes one or more storage systems and/or one or more devices that use virtualization techniques within the storage systems or devices of computing resource 225. In some implementations, within the context of a storage system, types of virtualizations can include block virtualization and file virtualization. Block virtualization can refer to abstraction (or separation) of logical storage from physical storage so that the storage system can be accessed without regard to physical storage or heterogeneous structure. The separation can permit administrators of the storage system flexibility in how the administrators manage storage for end users. File virtualization can eliminate dependencies between data accessed at a file level and a location where files are physically stored. This can enable optimization of storage use, server consolidation, and/or performance of non-disruptive file migrations.

Hypervisor 225-4 provides hardware virtualization techniques that allow multiple operating systems (e.g., "guest operating systems") to execute concurrently on a host computer, such as computing resource 225. Hypervisor 225-4 can present a virtual operating platform to the guest operating systems, and can manage the execution of the guest operating systems. Multiple instances of a variety of operating systems can share virtualized hardware resources.

Network 240 includes one or more wired and/or wireless networks. For example, network 240 can include a cellular network (e.g., a long-term evolution (LTE) network, a code division multiple access (CDMA) network, a 3G network, a 4G network, a 5G network, another type of next generation network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks.

Telematics device 250 includes one or more devices capable of receiving, generating, storing, processing, and/or providing information associated with a vehicle. For example, telematics device 250 can include a telemetry device such as a telematics sensor, a positioning sensor, and/or a communication component (e.g., a mobile phone device, a wireless communication device, and/or the like). In some implementations, the communication component can facilitate communication between telematics device 250 and the one or more other devices, such as user device 210, vehicle inspection report processing platform 220, and/or the like, via network 240.

The number and arrangement of devices and networks shown in FIG. 2 are provided as an example. In practice, there can be additional devices and/or networks, fewer devices and/or networks, different devices and/or networks, or differently arranged devices and/or networks than those shown in FIG. 2. Furthermore, two or more devices shown in FIG. 2 can be implemented within a single device, or a single device shown in FIG. 2 can be implemented as multiple, distributed devices. Additionally, or alternatively, a set of devices (e.g., one or more devices) of environment 200 can perform one or more functions described as being performed by another set of devices of environment 200.

Figure 3:
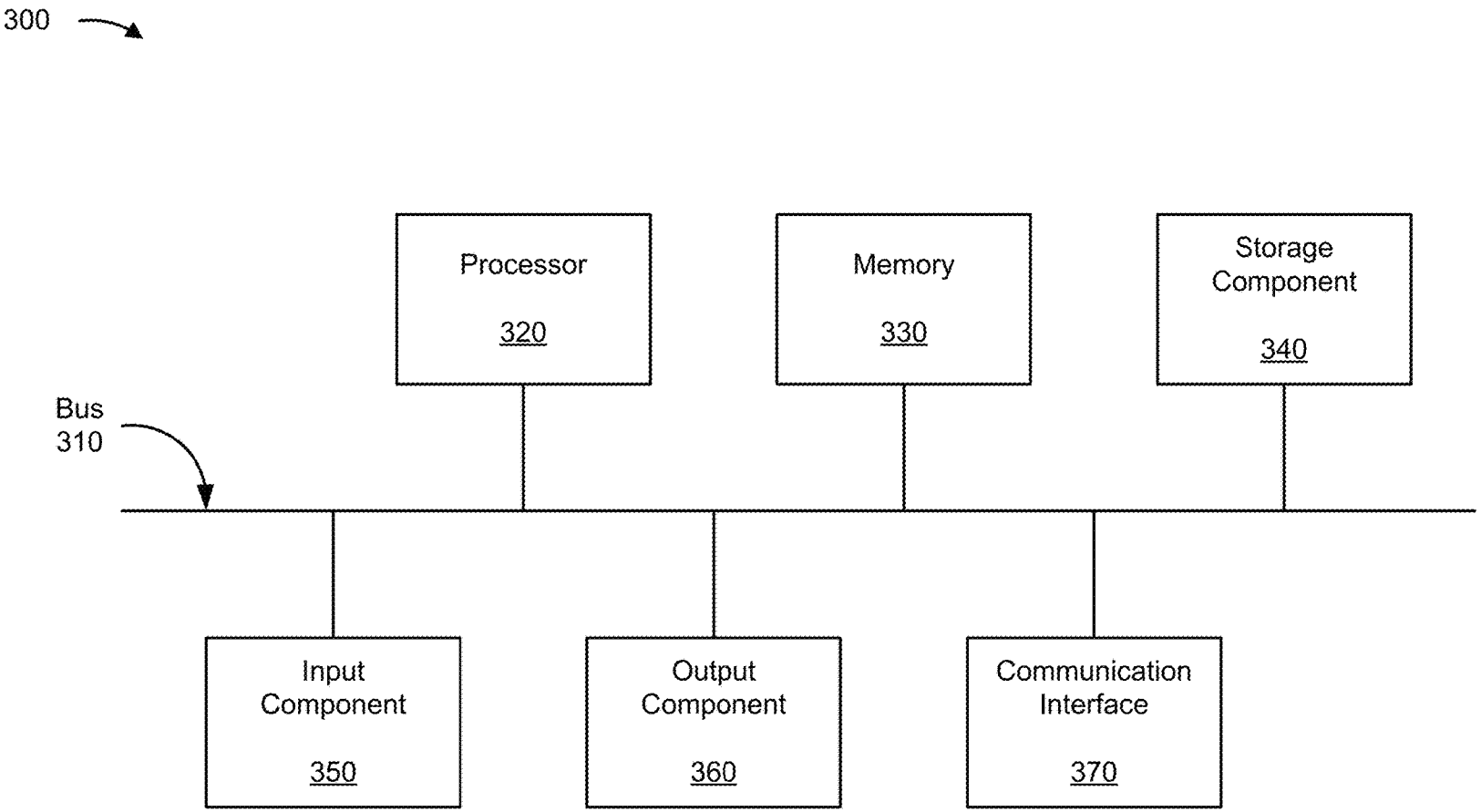
FIG. 3 is a diagram of example components of one or more devices of FIG. 2.

FIG. 3 is a diagram of example components of a device 300. Device 300 can correspond to user device 210, vehicle inspection report processing platform 220, computing resource 225, and/or telematics device 250. In some implementations, user device 210, vehicle inspection report processing platform 220, computing resource 225, and/or telematics device 250 can include one or more devices 300 and/or one or more components of device 300. As shown in FIG. 3, device 300 can include a bus 310, a processor 320, a memory 330, a storage component 340, an input component 350, an output component 360, and a communication interface 370.

Bus 310 includes a component that permits communication among the components of device 300. Processor 320 is implemented in hardware, firmware, or a combination of hardware and software. Processor 320 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 320 includes one or more processors capable of being programmed to perform a function. Memory 330 includes a random access memory (RAM), a read only memory (ROM), and/or another type of dynamic or static storage device (e.g., a flash memory, a magnetic memory, and/or an optical memory) that stores information and/or instructions for use by processor 320.

Storage component 340 stores information and/or software related to the operation and use of device 300. For example, storage component 340 can include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 350 includes a component that permits device 300 to receive information, such as via user input (e.g., a touch screen display, a keyboard, a keypad, a mouse, a button, a switch, and/or a microphone). Additionally, or alternatively, input component 350 can include a sensor for sensing information (e.g., a global positioning system (GPS) component, an accelerometer, a gyroscope, and/or an actuator). Output component 360 includes a component that provides output information from device 300 (e.g., a display, a speaker, and/or one or more light-emitting diodes (LEDs)).

Communication interface 370 includes a transceiver-like component (e.g., a transceiver and/or a separate receiver and transmitter) that enables device 300 to communicate with other devices, such as via a wired connection, a wireless connection, or a combination of wired and wireless connections. Communication interface 370 can permit device 300 to receive information from another device and/or provide information to another device. For example, communication interface 370 can include an Ethernet interface, an optical interface, a coaxial interface, an infrared interface, a radio frequency (RF) interface, a universal serial bus (USB) interface, a wireless local area network interface, a cellular network interface, or the like.

Device 300 can perform one or more processes described herein. Device 300 can perform these processes based on processor 320 executing software instructions stored by a non-transitory computer-readable medium, such as memory 330 and/or storage component 340. A computer-readable medium is defined herein as a non-transitory memory device. A memory device includes memory space within a single physical storage device or memory space spread across multiple physical storage devices.

Software instructions can be read into memory 330 and/or storage component 340 from another computer-readable medium or from another device via communication interface 370. When executed, software instructions stored in memory 330 and/or storage component 340 can cause processor 320 to perform one or more processes described herein. Additionally, or alternatively, hardwired circuitry can be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 can include additional components, fewer components, different components, or differently arranged components than those shown in FIG. 3. Additionally, or alternatively, a set of components (e.g., one or more components) of device 300 can perform one or more functions described as being performed by another set of components of device 300.

Figure 4A:
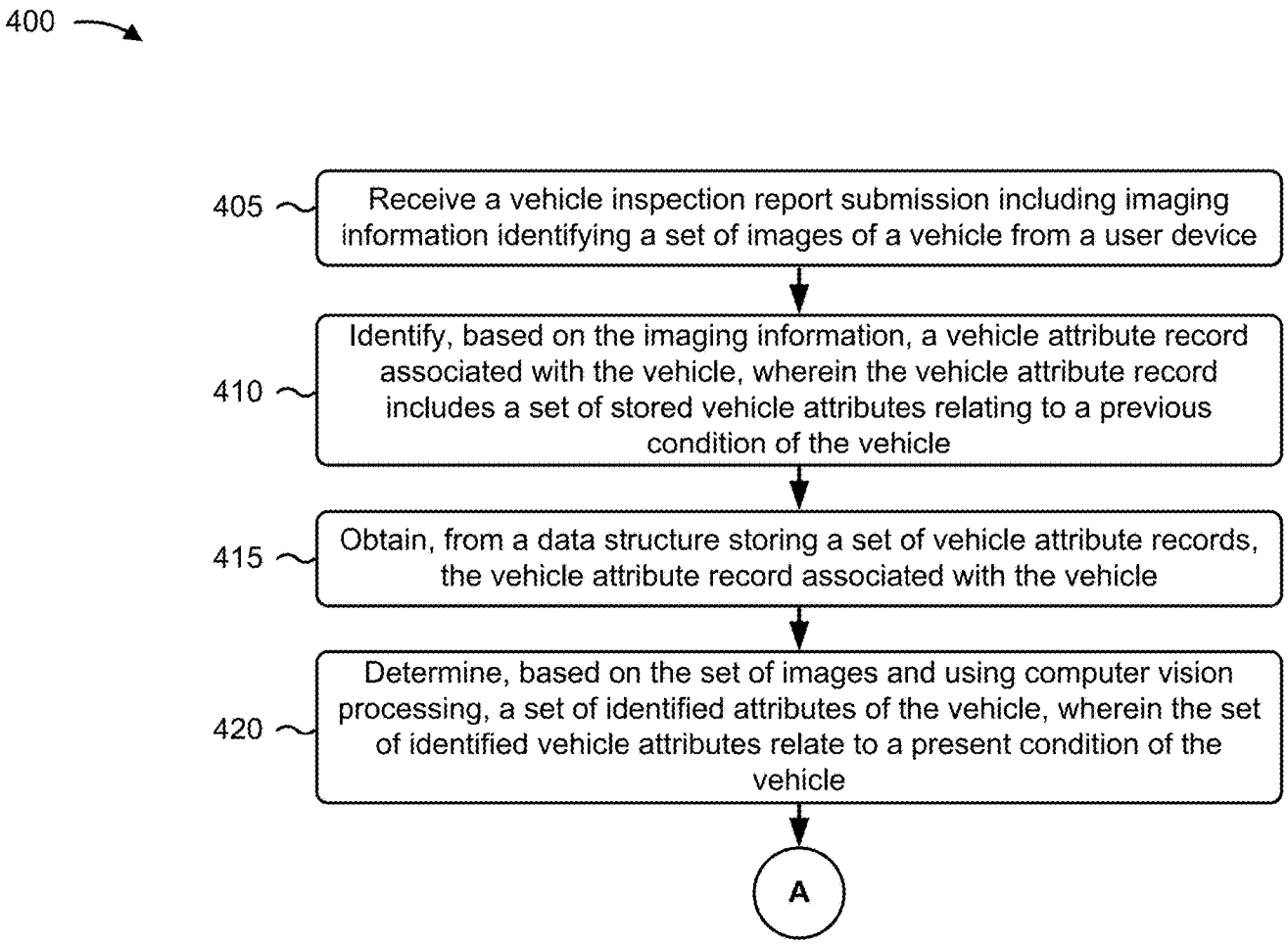
FIGS. 4A and 4B are flow charts of an example process for computer vision based vehicle inspection report automation.
Figure 4B:
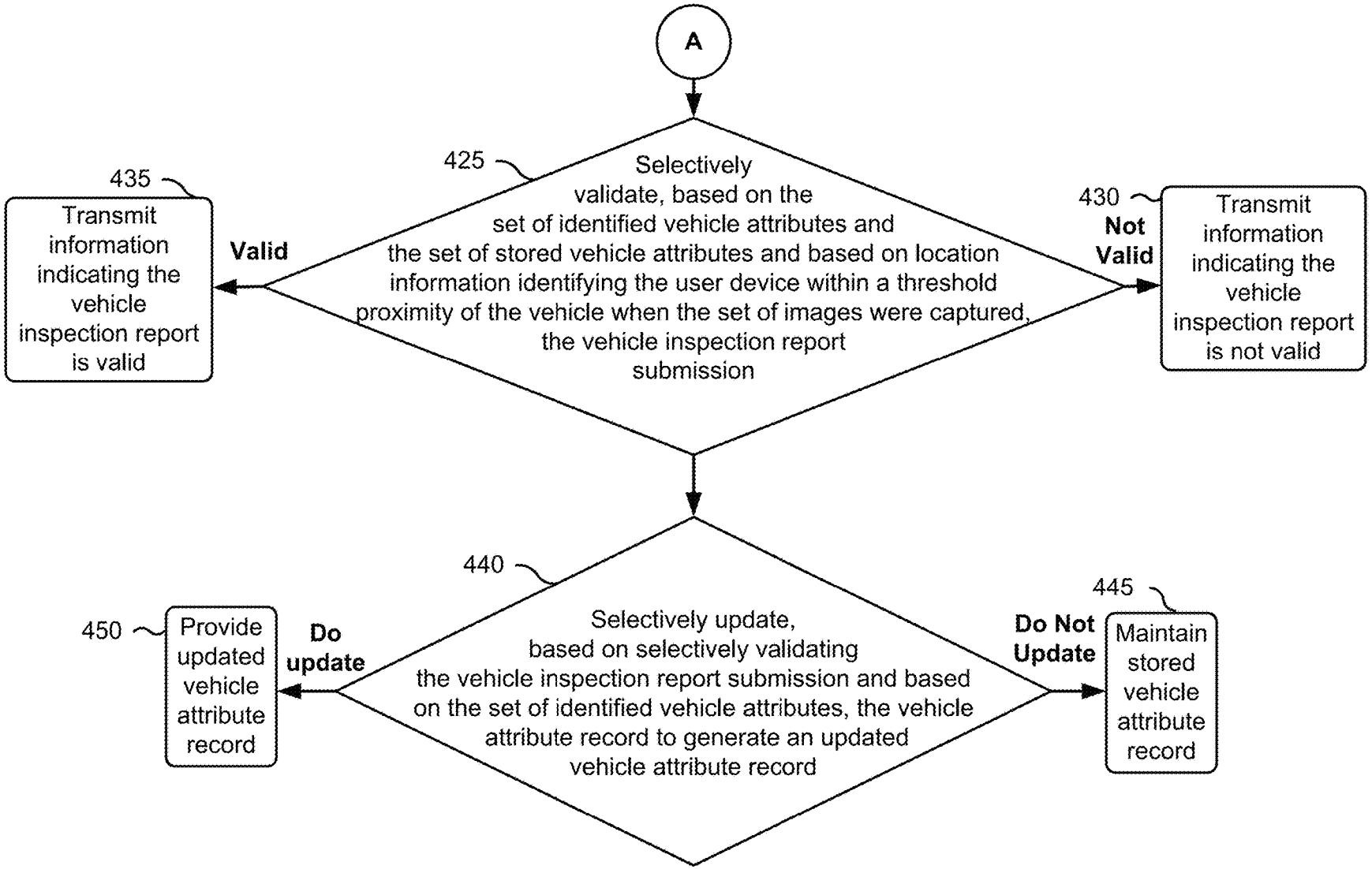

FIGS. 4A-4B are flow charts of an example process 400 for automatic vehicle inspection report processing. In some implementations, one or more process blocks of FIGS. 4A-4B can be performed by a vehicle inspection report processing platform (e.g. vehicle inspection report processing platform 220). In some implementations, one or more process blocks of FIG. 4 can be performed by another device or a group of devices separate from or including the vehicle inspection report processing platform (e.g. vehicle inspection report processing platform 220), such as a user device (e.g. user device 210), a computing resource (e.g. computing resource 225), and a telematics device (e.g. telematics device 250).

As shown in FIG. 4A, process 400 can include receiving a vehicle inspection report submission including imaging information identifying a set of images of a vehicle from a user device (block 405). For example, the vehicle inspection report processing platform (e.g., using computing resource 225, processor 320, memory 330, storage component 340, input component 350, communication interface 370, and/or the like) can receive a vehicle inspection report submission including imaging information identifying a set of images of a vehicle from a user device, as described above.

As further shown in FIG. 4A, process 400 can include identifying, based on the imaging information, a vehicle attribute record associated with the vehicle, wherein the vehicle attribute record includes a set of stored vehicle attributes relating to a previous condition of the vehicle (block 410). For example, the vehicle inspection report processing platform (e.g., using computing resource 225, processor 320, memory 330, storage component 340, and/or the like) can identify, based on the imaging information, a vehicle attribute record associated with the vehicle, as described above. In some implementations, the vehicle attribute record includes a set of stored vehicle attributes relating to a previous condition of the vehicle.

As shown in FIG. 4A, process 400 can include obtaining, from a data structure storing a set of vehicle attribute records, the vehicle attribute record associated with the vehicle (block 415). For example, the vehicle inspection report processing platform (e.g., using computing resource 225, processor 320, memory 330, storage component 340, communication interface 370, and/or the like) can obtain, from a data structure storing a set of vehicle attribute records, the vehicle attribute record associated with the vehicle, as described above.

As further shown in FIG. 4A, process 400 can include determining, based on the set of images and using computer vision processing, a set of identified vehicle attributes of the vehicle, wherein the set of identified vehicle attributes relate to a present condition of the vehicle (block 420). For example, the vehicle inspection report processing platform (e.g., using computing resource 225, processor 320, memory 330, storage component 340, communication interface 370, and/or the like) can determine, based on the set of images and using computer vision processing, a set of identified vehicle attributes of the vehicle, as described above. In some implementations, the set of identified vehicle attributes relate to a present condition of the vehicle.

As shown in FIG. 4B, process 400 can include selectively validating, based on the set of identified vehicle attributes and the set of stored vehicle attributes and based on location information identifying the user device within a threshold proximity of the vehicle when the set of images were captured, the vehicle inspection report submission (block 425). For example, the vehicle inspection report processing platform (e.g., using computing resource 225, processor 320, memory 330, storage component 340, and/or the like) can selectively validate, based on the set of identified vehicle attributes and the set of stored vehicle attributes and based on location information identifying the user device within a threshold proximity of the vehicle when the set of images were captured, the vehicle inspection report submission, as described above.

As further shown in FIG. 4B, if vehicle inspection report processing platform 220 determines that the vehicle inspection report submission is not valid (block 425—Not Valid), then process 400 can include transmitting information indicating the vehicle inspection report is not valid (block 430). For example, the vehicle inspection report processing platform (e.g., using computing resource 225, processor 320, memory 330, storage component 340, output component 360, communication interface 370, and/or the like) can transmit information indicating the vehicle inspection report is not valid, as described above.

As further shown in FIG. 4B, if vehicle inspection report processing platform 220 determines that the vehicle inspection report submission is valid (block 425—Valid), then process 400 can include transmitting information indicating the vehicle inspection report is valid (block 435). For example, the vehicle inspection report processing platform (e.g., using computing resource 225, processor 320, memory 330, storage component 340, output component 360, communication interface 370, and/or the like) can transmit information indicating the vehicle inspection report is valid, as described above.

As shown in FIG. 4B, process 400 can include selectively updating, based on selectively validating the vehicle inspection report submission, the set of identified vehicle attributes, and update information selectively included in the vehicle inspection report submission, the vehicle attribute record to generate an updated vehicle attribute record (block 440). For example, the vehicle inspection report processing platform (e.g., using computing resource 225, processor 320, memory 330, storage component 340, communication interface 370, and/or the like) can selectively update, based on selectively validating the vehicle inspection report submission, the set of identified vehicle attributes, and update information selectively included in the vehicle inspection report submission, the vehicle attribute record to generate an updated vehicle attribute record, the vehicle inspection report submission, as described above.

As further shown in FIG. 4B, if vehicle inspection report processing platform 220 determines that the vehicle attribute record is not to be updated (block 440—Do Not Update), then process 400 can include maintaining the stored vehicle attribute record (block 445). For example, the vehicle inspection report processing platform (e.g., using computing resource 225, processor 320, memory 330, storage component 340, and/or the like) can maintain the stored vehicle attribute record, as described above.

As further shown in FIG. 4B, if vehicle inspection report processing platform 220 determines that the vehicle attribute record to generate an updated vehicle attribute record is updated (block 440—Do Update), then process 400 can include providing the updated vehicle attribute record (block 450). For example, the vehicle inspection report processing platform (e.g., using computing resource 225, processor 320, memory 330, storage component 340, communication interface 370, and/or the like) can provide the updated vehicle attribute record, as described above.

Process 400 can include additional implementations, such as any single implementation or any combination of implementations described below and/or in connection with one or more other processes described elsewhere herein.

In some implementations, when selectively validating the vehicle inspection report submission, the vehicle inspection report processing platform can determine that an identified vehicle attribute, of the set of identified vehicle attributes, associated with an image, of the set of images, matches a corresponding stored vehicle attribute, of the set of stored vehicle attributes, associated with a previous image of the vehicle, and can validate the vehicle inspection report submission based on determining that the identified vehicle attribute matches the corresponding stored vehicle attribute.

In some implementations, when selectively validating the vehicle inspection report submission, the vehicle inspection report processing platform can validate the vehicle inspection report submission based on information in the vehicle inspection report submission identifying a proximity of the user device to the vehicle. In some implementations, when selectively validating the vehicle inspection report submission, the vehicle inspection report processing platform can identify a vehicle identifier in an image, of the set of images, can determine that the vehicle identifier in the image matches a stored vehicle identifier of the set of stored vehicle attributes, and can validate the vehicle inspection report submission based on determining that the vehicle identifier in the image matches the stored vehicle identifier.

In some implementations, when selectively validating the vehicle inspection report submission, the vehicle inspection report processing platform can determine that the vehicle inspection report submission is invalid, and, when transmitting the information identifying the result of selectively validating the vehicle inspection report submission, the vehicle inspection report processing platform can transmit a notification to the user device to indicate that the vehicle inspection report submission is invalid and to request a new vehicle inspection report submission.

In some implementations, when selectively updating the vehicle attribute record, the vehicle inspection report processing platform can determine an attribute change based on an attribute change report included in the vehicle inspection report submission, and can modify at least one stored vehicle attribute of the set of stored vehicle attributes based on determining the attribute change.

In some implementations, the vehicle inspection report processing platform can determine an attribute change based on an attribute change report included in the vehicle inspection report submission or based on a comparison of an identified vehicle attribute to a stored vehicle attribute, can classify the attribute change into a particular class of attribute changes, and can selectively schedule maintenance for the vehicle based on classifying the attribute change into the particular class of attribute changes.

Although FIG. 4 shows example blocks of process 400, in some implementations, process 400 can include additional blocks, fewer blocks, different blocks, or differently arranged blocks than those depicted in FIG. 4. Additionally, or alternatively, two or more of the blocks of process 400 can be performed in parallel.

The foregoing disclosure provides illustration and description, but is not intended to be exhaustive or to limit the implementations to the precise form disclosed. Modifications and variations can be made in light of the above disclosure or can be acquired from practice of the implementations.

As used herein, the term "component" is intended to be broadly construed as hardware, firmware, or a combination of hardware and software.

Some implementations are described herein in connection with thresholds. As used herein, satisfying a threshold can refer to a value being greater than the threshold, more than the threshold, higher than the threshold, greater than or equal to the threshold, less than the threshold, fewer than the threshold, lower than the threshold, less than or equal to the threshold, equal to the threshold, or the like.

Certain user interfaces have been described herein and/or shown in the figures. A user interface can include a graphical user interface, a non-graphical user interface, a text-based user interface, or the like. A user interface can provide information for display. In some implementations, a user can interact with the information, such as by providing input via an input component of a device that provides the user interface for display. In some implementations, a user interface can be configurable by a device and/or a user (e.g., a user can change the size of the user interface, information provided via the user interface, a position of information provided via the user interface, etc.). Additionally, or alternatively, a user interface can be pre-configured to a standard configuration, a specific configuration based on a type of device on which the user interface is displayed, and/or a set of configurations based on capabilities and/or specifications associated with a device on which the user interface is displayed.

To the extent the aforementioned implementations collect, store, or employ personal information of individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

It will be apparent that systems and/or methods, described herein, can be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of various implementations. In fact, many of these features can be combined in ways not specifically recited in the claims and/or disclosed in the specification. Although each dependent claim listed below can directly depend on only one claim, the disclosure of various implementations includes each dependent claim in combination with every other claim in the claim set.

No element, act, or instruction used herein should be construed as critical or essential unless explicitly described as such. Also, as used herein, the articles "a" and "an" are intended to include one or more items, and can be used interchangeably with "one or more." Furthermore, as used herein, the term "set" is intended to include one or more items (e.g., related items, unrelated items, a combination of related and unrelated items, etc.), and can be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A device, comprising:

one or more memories; and one or more processors, communicatively coupled to the one or more memories, to:

receive a vehicle inspection report submission including imaging information identifying a set of images of a vehicle from a user device;

identify, based on the imaging information, a vehicle attribute record associated with the vehicle, wherein the vehicle attribute record includes a set of stored vehicle attributes relating to a previous condition of the vehicle, and wherein the set of stored vehicle attributes includes a stored vehicle attribute associated with a first vehicle wear;

obtain, from among a set of vehicle attribute records, the vehicle attribute record associated with the vehicle;

determine, based on the set of images and using computer vision processing, a set of identified vehicle attributes of the vehicle, wherein the set of identified vehicle attributes relates to a present condition of the vehicle and includes an identified vehicle attribute corresponding to the stored vehicle attribute and associated with a second vehicle wear greater than the first vehicle wear;

obtain location information associated with the user device;

determine, based on the location information, that the user device was within a threshold proximity of the vehicle when the set of images were captured, wherein the one or more processors, to determine that the user device was within the threshold proximity of the vehicle when the set of images were captured, are configured to determine that the user device was within the threshold proximity of the vehicle when the set of images were captured based on a unique code displayed by a telematics device of the vehicle at a time associated with when the set of images were captured, wherein the unique code is visible in the set of images;

selectively validate, based on the set of identified vehicle attributes and the set of stored vehicle attributes and based on determining that the user device was within the threshold proximity of the vehicle when the set of images were captured, the vehicle inspection report submission using a statistical model to determine that the second vehicle wear is expected to occur to the identified vehicle attribute with at least a threshold of likelihood as predicted by the device;

transmit, based on selectively validating the vehicle inspection report submission, information identifying a result of selectively validating the vehicle inspection report submission;

selectively update, based on selectively validating the vehicle inspection report submission and based on the set of identified vehicle attributes, the vehicle attribute record to generate an updated vehicle attribute record; and selectively provide the updated vehicle attribute record.

2. The device of claim 1, wherein the one or more processors, when selectively validating the vehicle inspection report submission, are to:

determine that the identified vehicle attribute, associated with an image of the set of images, matches the stored vehicle attribute, associated with a previous image of the vehicle; and validate the vehicle inspection report submission based on determining that the identified vehicle attribute matches the stored vehicle attribute.

3. The device of claim 1, wherein the one or more processors, when selectively validating the vehicle inspection report submission, are to:

validate the vehicle inspection report submission based on information in the vehicle inspection report submission identifying a proximity of the user device to the vehicle.

4. The device of claim 1, wherein the one or more processors, when selectively validating the vehicle inspection report submission, are to:

identify a vehicle identifier in an image, of the set of images;

determine that the vehicle identifier in the image matches a stored vehicle identifier of the set of stored vehicle attributes; and validate the vehicle inspection report submission based on determining that the vehicle identifier in the image matches the stored vehicle identifier.

5. The device of claim 1, wherein the one or more processors, when selectively validating the vehicle inspection report submission, are to:

determine that the vehicle inspection report submission is invalid; and wherein the one or more processors, when transmitting the information identifying the result of selectively validating the vehicle inspection report submission, are to:

transmit a notification to the user device to indicate that the vehicle inspection report submission is invalid and to request a new vehicle inspection report submission.

6. The device of claim 1, wherein the one or more processors, when selectively updating the vehicle attribute record, are to:

determine an attribute change, associated with the second vehicle wear, based on an attribute change report included in the vehicle inspection report submission; and modify the stored vehicle attribute based on determining the attribute change.

7. The device of claim 1, wherein the one or more processors are further to:

determine an attribute change, associated with the second vehicle wear, based on an attribute change report included in the vehicle inspection report submission or based on a comparison of the identified vehicle attribute to the stored vehicle attribute;

classify the attribute change into a particular class of attribute changes; and selectively schedule maintenance for the vehicle based on classifying the attribute change into the particular class of attribute changes.

8. A non-transitory computer-readable medium storing one or more instructions for wireless communication, the one or more instructions comprising:

one or more instructions that, when executed by one or more processors of a device, cause the one or more processors to:

receive a vehicle inspection report submission including imaging information identifying a set of images of a vehicle from a user device;

identify, based on the imaging information, a vehicle attribute record associated with the vehicle, wherein the vehicle attribute record includes a set of stored vehicle attributes relating to a previous condition of the vehicle, and wherein the set of stored vehicle attributes includes a stored vehicle attribute associated with a first vehicle wear;

obtain, from among a set of vehicle attribute records, the vehicle attribute record associated with the vehicle;

determine, based on the set of images and using computer vision processing, a set of identified vehicle attributes of the vehicle, wherein the set of identified vehicle attributes relates to a present condition of the vehicle and includes an identified vehicle attribute corresponding to the stored vehicle attribute and associated with a second vehicle wear greater than the first vehicle wear;

obtain location information associated with the user device;

determine, based on the location information, that the user device was within a threshold proximity of the vehicle when the set of images were captured, wherein the one or more instructions, that cause the one or more processors to determine that the user device was within the threshold proximity of the vehicle when the set of images were captured, cause the one or more processors to determine that the user device was within the threshold proximity of the vehicle when the set of images were captured based on a unique code displayed by a telematics device of the vehicle at a time associated with when the set of images were captured, wherein the unique code is visible in the set of images;

selectively validate, based on the set of identified vehicle attributes and the set of stored vehicle attributes and based on determining that the user device was within the threshold proximity of the vehicle when the set of images were captured, the vehicle inspection report submission using a statistical model to determine that the second vehicle wear is expected to occur to the identified vehicle attribute with at least a threshold of likelihood as predicted by the device;

transmit, based on selectively validating the vehicle inspection report submission, information identifying a result of selectively validating the vehicle inspection report submission;

selectively update, based on selectively validating the vehicle inspection report submission and based on the set of identified vehicle attributes, the vehicle attribute record to generate an updated vehicle attribute record; and selectively provide the updated vehicle attribute record.

9. The non-transitory computer-readable medium of claim 8, wherein the one or more instructions, that cause the one or more processors to selectively validate the vehicle inspection report submission, cause the one or more processors to:

determine that the identified vehicle attribute, associated with an image of the set of images, matches the stored vehicle attribute, associated with a previous image of the vehicle; and validate the vehicle inspection report submission based on determining that the identified vehicle attribute matches the stored vehicle attribute.

10. The non-transitory computer-readable medium of claim 8, wherein the one or more instructions, that cause the one or more processors to selectively validate the vehicle inspection report submission, cause the one or more processors to:

validate the vehicle inspection report submission based on information in the vehicle inspection report submission identifying a proximity of the user device to the vehicle.

11. The non-transitory computer-readable medium of claim 8, wherein the one or more instructions, that cause the one or more processors to selectively validate the vehicle inspection report submission, cause the one or more processors to:

identify a vehicle identifier in an image, of the set of images;

determine that the vehicle identifier in the image matches a stored vehicle identifier of the set of stored vehicle attributes; and validate the vehicle inspection report submission based on determining that the vehicle identifier in the image matches the stored vehicle identifier.

12. The non-transitory computer-readable medium of claim 8, wherein the one or more instructions, that cause the one or more processors to selectively validate the vehicle inspection report submission, cause the one or more processors to:

determine that the vehicle inspection report submission is invalid; and wherein the one or more instructions, that cause the one or more processors to transmit the information identifying the result of selectively validating the vehicle inspection report submission, cause the one or more processors to:

transmit a notification to the user device to indicate that the vehicle inspection report submission is invalid and to request a new vehicle inspection report submission.

13. The non-transitory computer-readable medium of claim 8, wherein the one or more instructions, that cause the one or more processors to selectively update the vehicle attribute record, cause the one or more processors to:

determine an attribute change, associated with the second vehicle wear, based on an attribute change report included in the vehicle inspection report submission; and modify the stored vehicle attribute based on determining the attribute change.

14. The non-transitory computer-readable medium of claim 8, wherein the one or more instructions, when executed by the processors, further cause the one or more processors to:

determine an attribute change, associated with the second vehicle wear, based on an attribute change report included in the vehicle inspection report submission or based on a comparison of an identified vehicle attribute to a stored vehicle attribute;

classify the attribute change into a particular class of attribute changes; and selectively schedule maintenance for the vehicle based on classifying the attribute change into the particular class of attribute changes.

15. A method, comprising:

receiving, by a device, a vehicle inspection report submission including imaging information identifying a set of images of a vehicle from a user device;

identifying, by the device and based on the imaging information, a vehicle attribute record associated with the vehicle, wherein the vehicle attribute record includes a set of stored vehicle attributes relating to a previous condition of the vehicle, and wherein the set of stored vehicle attributes includes a stored vehicle attribute associated with a first vehicle wear;

obtaining, by the device and from among a set of vehicle attribute records, the vehicle attribute record associated with the vehicle;

determining, by the device and based on the set of images and using computer vision processing, a set of identified vehicle attributes of the vehicle, wherein the set of identified vehicle attributes relates to a present condition of the vehicle and includes an identified vehicle attribute corresponding to the stored vehicle attribute and associated with a second vehicle wear greater than the first vehicle wear;

obtaining, by the device, location information associated with the user device;

determining, by the device and based on the location information, that the user device was within a threshold proximity of the vehicle when the set of images were captured, wherein determining that the user device was within the threshold proximity of the vehicle when the set of images were captured is based on a unique code displayed by a telematics device of the vehicle at a time associated with when the set of images were captured, wherein the unique code is visible in the set of images;

selectively validating, by the device and based on the set of identified vehicle attributes and the set of stored vehicle attributes and based on determining that the user device was within the threshold proximity of the vehicle when the set of images were captured, the vehicle inspection report submission using a statistical model to determine that the second vehicle wear is expected to occur to the identified vehicle attribute with at least a threshold of likelihood as predicted by the device;

transmitting, by the device and based on selectively validating the vehicle inspection report submission, information identifying a result of selectively validating the vehicle inspection report submission;

selectively updating, by the device and based on selectively validating the vehicle inspection report submission and based on the set of identified vehicle attributes, the vehicle attribute record to generate an updated vehicle attribute record; and selectively providing, by the device, the updated vehicle attribute record.

16. The method of claim 15, wherein selectively validating the vehicle inspection report submission comprises:

determining that the identified vehicle attribute, associated with an image of the set of images, matches the stored vehicle attribute, associated with a previous image of the vehicle; and validating the vehicle inspection report submission based on determining that the identified vehicle attribute matches the stored vehicle attribute.

17. The method of claim 15, wherein selectively validating the vehicle inspection report submission comprises:

validating the vehicle inspection report submission based on information in the vehicle inspection report submission identifying a proximity of the user device to the vehicle.

18. The method of claim 15, wherein selectively validating the vehicle inspection report submission comprises:

identifying a vehicle identifier in an image, of the set of images;

determining that the vehicle identifier in the image matches a stored vehicle identifier of the set of stored vehicle attributes; and validating the vehicle inspection report submission based on determining that the vehicle identifier in the image matches the stored vehicle identifier.

19. The method of claim 15, wherein selectively validating the vehicle inspection report submission comprises:

determining that the vehicle inspection report submission is invalid; and wherein transmitting the information identifying the result of selectively validating the vehicle inspection report submission comprises:

transmitting a notification to the user device to indicate that the vehicle inspection report submission is invalid and to request a new vehicle inspection report submission.

20. The method of claim 15, wherein selectively updating the vehicle attribute record comprises:

determining an attribute change, associated with the second vehicle wear, based on an attribute change report included in the vehicle inspection report submission; and modifying the stored vehicle attribute based on determining the attribute change.

* * * * *